US006960384B2

(12) United States Patent
Amberkar et al.

(10) Patent No.: US 6,960,384 B2
(45) Date of Patent: Nov. 1, 2005

(54) PRINT RECEPTIVE LAYER FOR UNCOATED ARTICLE

(75) Inventors: Suresh D. Amberkar, Traverse City, MI (US); Jerry Bernard, Traverse City, MI (US)

(73) Assignee: Illinois Tool Works Inc., Glenview, IL (US)

( * ) Notice: Subject to any disclaimer, the term of this patent is extended or adjusted under 35 U.S.C. 154(b) by 266 days.

(21) Appl. No.: 09/878,537

(22) Filed: Jun. 11, 2001

(65) Prior Publication Data

US 2002/0187898 A1 Dec. 12, 2002

Related U.S. Application Data

(60) Provisional application No. 60/295,159, filed on Jun. 1, 2001.

(51) Int. Cl.[7] ..... B41M 5/00
(52) U.S. Cl. ..... 428/195.1; 428/32.79
(58) Field of Search ..... 428/195.1, 32.75, 428/32.79, 195; 503/227

(56) References Cited

U.S. PATENT DOCUMENTS 5,006,502 A * 4/1991 Fujimura et al. ..... 503/227
5,658,677 A * 8/1997 Ebisch et al. ..... 428/537.5
6,156,416 A * 12/2000 Daems et al. ..... 428/213

* cited by examiner

*Primary Examiner*—B. Hamilton Hess
(74) *Attorney, Agent, or Firm*—Greer, Burns & Crain Ltd.; Mark W. Croll; Jay A. Saltzman

(57) ABSTRACT

The present invention provides an article with an image contained in an image-receptive layer that is bonded to the surface of the article with a size coat. A carrier film, which has been coated with a polymeric resin image-receptive layer and a size coat, forms a wrap that is used to receive the image. Use of the wrap in a method for imparting a design on an untreated article begins by covering the article in the area to receive printing with the wrap being positioned with the size coat adjacent to the article. Heat and pressure are used to treat the wrap while in contact with the article for sufficient time to bond the size coat to the article. The carrier film is removed from the article, leaving the size coat and the receptive layer bonded to the article. A transfer sheet, that includes an image to be transferred, is placed against the article with the image being placed in contact with the receptive layer. A second treating step, with the transfer sheet in contact with the article, provides sufficient heat and pressure for a sufficient time to bond the image to the receptive layer. Finally, the transfer sheet is removed from the article, leaving the image bonded to the receptive layer.

19 Claims, No Drawings

PRINT RECEPTIVE LAYER FOR UNCOATED ARTICLE

CROSS REFERENCE TO RELATED APPLICATION

This application is related to prior provisional application Ser. No. 60/295,159, filed Jun. 1, 2001, which is hereby incorporated by reference. This application claims priority from that provisional application under 35 U.S.C. §119.

FIELD OF THE INVENTION

This invention relates to a wrap for an article that adheres to an article, such as a mug, plate, metal article, ceramic tile, glass or plastic articles. The wrap imparts a receptive layer to the surface that allows transfer of a color image from a dye-sub or standard toner image.

BACKGROUND OF THE INVENTION

Gift, souvenir or premium items are frequently printed with characters, logos or designs to make them more desirable. Many people greatly enjoy choosing designs, slogans or personalization, and having unique gifts made while they wait. The ready availability of computers and computer printers has also made production of personalized, one-of a-kind items and items designed on demand commonplace, particularly when the goods are made of paper. However, there is currently no fast economical way to produce individually designed items made of ceramic or ceramic tile.

Traditionally these items, such as a mug, are screen-printed. The image is allowed to dry, then placed in a furnace at 800° F. to 1200° F. to cure the image on the mug. This process is very time consuming and expensive, with limited flexibility. The process is not suitable for preparation of goods on demand. Labor involved in preparation of the screens and firing of the furnace make the process generally expensive, but especially for small quantities of goods, the cost becomes prohibitive.

As an alternative, 'coated mugs' of ceramic are used for digital printing and for creating items on demand. An uncoated mug may be spray coated or dip coated in a bath to impart a coating that is receptive to transfer of inks from a dye-sub or toner image. However, use of such technology requires investment in additional spray-coating equipment or baths for dipping such articles. Articles that need to be coated have to be made in advance so that the coating has time to dry or cure.

This method is also disadvantageous for the vendor who produces the decorative articles. The vendor must now stock both coated and uncoated goods. This is expensive, not only in terms of the inventory he must carry, but also in terms of storage or warehouse space in which the items are stocked.

Articles of glass or metal can be engraved on demand but such processes require very expensive, computer-controlled engraving equipment. This process is also relatively slow, taking 20 minutes or more to engrave several words. The technique does not reproduce color, a huge disadvantage when attempting to capture multi-color graphics.

Polymer coatings are known in the art as outer layers for credit or identification cards to protect the images contained on the card from wear and weather. In particular, it is known to coat a polyester film with a polymeric layer and adhesive, and then transfer the adhesive and polymeric layer to the card with heat and pressure. The polymeric layer is a clear, protective coating, allowing images contained on the substrate card to show through.

It is therefore an object of this invention to provide an improved process for transferring an image onto ceramic articles.

Another object of this invention is to provide an improved process for transferring an image onto articles that do not require any prior coating or treatment.

Still another object of this invention is to provide an improved and economical process for making low volume or short run articles.

Yet another object of this invention is to provide an improved process for making articles with graphics designed and applied on demand.

SUMMARY OF THE INVENTION

These and other objects are met or exceeded by the present invention which features a method of transferring an image onto an article, such as a ceramic mug, that is effective on uncoated or untreated articles. The invention provides an article with an image printed thereon and a method for making the article. It has unexpectedly been discovered that a wrap, previously used as a protective coating for credit or identification cards, is useful as a receptive layer for a printer image when the receptive layer is bonded to an article, such as a mug.

More specifically, the present invention provides an article with an image contained in an image-receptive layer that is bonded to the surface of the article with a size coat. A carrier film, which has been coated with a polymeric resin image-receptive layer and a size coat, forms a wrap that is used to receive the image. Use of the wrap in a method for imparting a design on an untreated article begins by covering the article in the area to receive printing with the wrap being positioned with the size coat adjacent to the article. Heat and pressure are used to treat the wrap while in contact with the article for sufficient time to bond the size coat to the article. The carrier film is removed from the article, leaving the size coat and the receptive layer bonded to the article. A transfer sheet, that includes an image to be transferred, is placed against the article with the image being placed in contact with the receptive layer. A second treating step, with the transfer sheet in contact with the article, provides sufficient heat and pressure for a sufficient time to bond the image to the receptive layer. Finally, the transfer sheet is removed from the article, leaving the image bonded to the receptive layer.

The article and method of this invention provide a simple and economical method of producing articles, even one-of-a-kind items or items having graphics designed on demand, with one or more images transferred to the surface of the article. Suitable articles are variable in size, shape and composition. Such articles need not be pretreated or precoated, allowing a vendor of such goods to minimize the variety of goods that must be warehoused or kept in stock. The vendor is creating an article with a receptive coating as part of the process of this invention.

DETAILED DESCRIPTION OF THE INVENTION

The article of the present invention is made using a wrap that includes a carrier film, a size layer and a receptive coating onto the article. Articles that are commonly found with images include mugs, plaques, trophies, ceramic tiles, souvenirs, items of metal, glass, wood or plastics. The articles need not have any special coating for use with this invention, and preferably have no such coating to minimize cost of the article. The term 'uncoated article' refers to an article that has no coating specifically intended to receive a printed image. In the following discussion, where a mug is discussed as a specific example of an article, it is understood that any article may be used that can hold an image and withstand heat and pressure required to transfer the image.

The carrier film is used to provide a base for the receptive layer and the size coat. Thickness of the carrier film varies substantially, but is preferably in the range of from about 4 microns to about 100 microns. Most preferably, the film is from about 6 microns to about 20 microns. Properties of the carrier film include flexibility to conform to the shape of the article to receive an image, heat resistance, and dimensional stability. Polymer films are the preferred carriers, with polyester film or polyimide film being most preferred. A 12 micron polyester film is most preferred.

The polymeric receptive layer is applied to the carrier film. Any polymer that is receptive to sublimable dyes or toner used in printing is suitable for use in this layer. Preferred materials include polyesters, polyurethanes, polyvinyls and polymethylmethacrylates. Polyesters are the most preferred because they are resistant to heat, they are very economical and they are good receptors for toner and dyes. The receptive layer is coated onto the carrier film at a rate of approximately 2–6 g/m$^2$.

As will be understood by one skilled in the art, modifiers are optionally added to polymers to change one or more properties. For example, plasticizers are added to make polymers more pliable, fumed silica and calcium carbonate are known as matting agents, or dyes and pigments, are known to change the color and/or provide an opaque color background. Other modifiers that are known to improve the lubricity, stretchability, slip or tackiness of the polymer may optionally be used.

On top of the receptive layer is the size coat. The size coat is a heat activated adhesive material that bonds the receptive layer to the article. During transfer of the receptive layer, the size coat is activated by heating the size coat until it softens sufficiently to become tacky and form an adhesive bond to the article surface. Polymeric materials are preferred, however, the exact choice of the size coat will depend on the surface that is to receive the image. For transfer of images to non-polymeric surfaces, the suitable polymeric size coat has a glass transition temperature, $T_g$, that is less than or equal to the transfer temperature used to bond the receptive layer to the article. When the image-receiving article is made of ceramic, glass, metal, wood, or other common materials that are not sensitive to such temperatures, transfer temperatures of from about 300° F. to about 400° F. are preferred, with temperatures of from about 350° to about 400° F. being most preferred. Transfer times up to 40 seconds are preferred. Although some users of the process will increase the temperature to make the transfer in very short times, the most preferred transfer time is 15–20 seconds.

When the image-receiving article has a polymeric surface, it is also possible to create the bond between the size coat and the surface by softening of article surface. If the transfer temperature exceeds the $T_g$ of the polymer on the article surface, the bond is created even if the $T_g$ of the size coat is not exceeded. Thus, transfer temperatures lower than the $T_g$ of the size coat are suitable, and will depend on the polymer used on the article surface. When temperatures at or above the $T_g$ of the article are used, care must be taken to remove the heat source before the article deforms to a noticeable extent. Heat is applied only until the surface becomes tacky, but is removed before deformation of the surface.

Choice of the size coat material depends upon the surface of the image-receiving article, however polymeric materials are generally most suitable. Vinyl chloride/vinyl acetate co-polymer, polyurethanes, polyesters, chlorinated polyolefins and polyarnides are preferred polymers for the size coat. Combinations or copolymers of these materials are also suitable. The most preferred size coat material is a co-polymer of vinyl chloride and vinyl acetate. The size coat is coated on the wrap on top of the receptive layer, using from about 0.2 g/m$^2$ to about 2.0 g/m$^2$.

An optional backcoat layer may be added, if desired, to minimize sticking of the film to the press used to transfer the receptive layer and size coat to the article. When used, the backcoat layer is coated on the side of the film not occupied by the receptive layer. Preferably, the backcoat is a release coating, such as those made from silicone polymers. As an alternative to using a backcoat, a reusable sheet of release coating, such as TEFLON® brand coating, is optionally placed between the press and the carrier film.

The suitable image to be transferred to the article is produced by many commonly used printers or copiers. Color or black images are equally suitable for use with this invention. Four types of images are preferred. The receptive layer readily receives common toner images, such as those created by most laser printers and copiers, as well as thermal transfer images from ribbons that are resin based or resin/wax based. The components of these images have better adhesion to the receptive layer than to the paper or film on which they are printed. When the receptive layer is heated and becomes soft, the adhesion of the image by the receptive layer exceeds the adhesion of the image to the transfer sheet. The image remains bonded to the receptive layer when the transfer sheet is removed.

Images from sublimable dyes, known as dye-sub images, are most preferred. The dye-sub dyes are available in some toner cartridges, ink-jet inks or thermal printer ribbons. During the transfer process from the transfer sheet to the article, the dyes sublime under heat and pressure, and penetrate the receptive layer, being absorbed therein.

The image is printed onto the transfer sheet, which is then heated to cause the image to adhere to the receptive layer. Ordinary paper, including coated paper, is the preferred transfer sheet due to its low cost and ready availability, however other sheet or film materials, such as acetate sheets or polymeric films are also suitable. The suitable transfer sheet is flexible enough to conform to the surface contours of the article receiving the image, and conducts heat from the heat source used during the transfer process. It should be noted that the image, after transfer to the article, appears as the mirror image of the printed copy.

The wrap is made by deposition of the receptive layer and the size coat on the carrier film using any suitable coating process. Preferred methods of coating include use of a gravure coater, a rod coater or a reverse roll coater, however, many other types of coating equipment, as are known to those skilled in the art, may suitably be used with this invention.

Prior to transfer of the wrap to an article such as a mug, the mug is covered with the wrap. The term 'covered' is intended to mean that the wrap covers the portion of the article that is intended to receive the image. It is not necessary to cover the entire surface of the mug with the wrap, although it will not harm the mug to do so. The image will be accepted onto the surface of the article only where the receptive layer has been transferred. Selective coverage of the article surface with the wrap may be used advantageously, if desired, to transfer only a portion of an available image to the article. For example, a portion of a repeating pattern one inch square may be transferred to an article by transferring to the mug only one inch square of the receptive layer. When the image with the repeating pattern is placed against the mug and heated, only the portion of the image in contact with the receptive layer is transferred.

In covering the mug, it is important that the size coat of the wrap be placed in contact with the surface of the mug. The size coat is the adhesive that causes the receptive layer to adhere to the mug. If the wrap has the optional backcoat, the wrap is oriented with the backcoat between the carrier film and the surface of the heat source.

With the wrap in place, the mug is then treated with heat and pressure to transfer the receptive surface from the carrier film to the mug surface. Commercial presses, such as a "mug press" are available that simultaneously supply heat and pressure for such purposes where the heated surface conforms to the shape of the article surface. Heat from the press is applied to the wrap, activating the size coat to soften it. As the sizing softens, the receptive layer adheres to the article. When the covered mug has been treated for a sufficient time that the receptive layer firmly adheres to the mug, the mug is removed from the press and the carrier film is peeled away from the mug. After carrier film is removed, the receptive layer is exposed, held firmly in place by the size coat adhesive between the receptive layer and the mug.

As discussed above, selection of the transfer temperature and the treatment time generally depends on the material that is selected for the size coat. For most articles, application of temperatures in the range of about 300° F. to 400° F. for up to 20 seconds is sufficient to activate the sizing. Time of heat exposure depends on the composition of the size coat and the article surface.

Next, the image on the transfer sheet is placed with the image in contact with the receptive layer. The image should be oriented exactly as the image is to be placed on the mug. No portion of the image will adhere to the mug unless the transfer layer is between the image and the mug.

With the transfer sheet in place, the mug is returned to the mug press for additional treatment with heat and pressure. During this step, the treatment causes adhesion of the image to the exposed receptive layer. When paper is used as the transfer sheet, temperatures of from about 300° F. to about 400° F. are preferred with from about 350° F. to about 400° F. being most preferred. At these temperatures, transfer times of up to 40 seconds are generally sufficient to affect the transfer with transfer times of from about 20 to about 25 seconds being most preferred. Longer transfer time is used at a lower transfer temperature. When the mug is removed from the mug press, the transfer sheet is peeled away from the receptive layer, leaving the image bonded to the mug.

While a particular embodiment of the present invention has been shown and described, it will be appreciated by those skilled in the art that changes and modifications may be made thereto without departing from the invention in its broader aspects and as set forth in the following claims.

What is claimed is:

1. An article with an image contained thereon, comprising:

said article;

a size coat between said article and a resin receptive layer; and said polymeric resin receptive layer having a multi-color toner image contained therein.

2. The article of claim 1, wherein said article comprises ceramic, glass, wood, metal, plastic or tile.

3. The article of claim 1, wherein said polymeric resin receptive layer comprises one of polyacrylate, polyester, polyurethane, polyvinyl chloride, polyvinyl acetate or co-polymers thereof.

4. The article of claim 1, wherein said carrier film has a thickness of from about 4 microns to about 100 microns.

5. The article of claim 4, wherein said carrier film has a thickness of from about 6 microns to about 20 microns.

6. The article of claim 1, wherein said size layer comprises a heat activated adhesive polymer.

7. The article of claim 6, wherein said adhesive polymer has a $T_g$ at or below said transfer temperature.

8. The article of claim 1, wherein said size layer comprises at least one of polyester, polyurethane, chlorinated polyolefin, polyamide, vinyl chloride/vinyl acetate co-polymer or co-polymers thereof.

9. The article of claim 1, wherein said article comprises a mug, a ceramic tile, or a plaque.

10. An article having a multi-color toner image thereon, comprising:

said article being uncoated;

a size coat, said size coat bonding said article to a polymeric resin receptive layer;

said receptive layer having been bonded to said article with an image-free wrap, said wrap comprising said size layer, said polymeric resin receptive layer and a carrier film, said wrap being positioned on the surface of said article with said size layer adjacent said article, said wrap then being treated with sufficient heat and pressure for sufficient time to bond said size layer and said receptive layer to said article, said carrier film being removed following treatment; and said multi-color toner image, wherein said multi-color toner image has been transferred from a transfer sheet to said article in a single step.

11. The article of claim 10, wherein said article comprises ceramic, glass, wood, metal, plastic or tile.

12. The article of claim 10, wherein said polymeric resin receptive layer comprises one of polyacrylate, polyester, polyurethane, polyvinyl chloride, polyvinyl acetate or co-polymers thereof.

13. The article of claim 10, wherein said carrier film has a thickness of from about 4 microns to about 100 microns.

14. The article of claim 13, wherein said carrier film has a thickness of from about 6 microns to about 20 microns.

15. The article of claim 10, wherein said size layer comprises a heat activated adhesive polymer.

16. The article of claim 15, wherein said size layer has a $T_g$ at or below said transfer temperature.

17. The article of claim 10, wherein said size layer comprises at least one of polyester, polyurethane, chlorinated polyolefin, polyamide, vinyl chloride/vinyl acetate co-polymer or co-polymers thereof.

18. The article of claim 10, wherein said article comprises a mug, a ceramic tile, or a plaque.

19. The article of claim 10, wherein said image had been created by a laser printer.

* * * * *